US009357860B1

(12) United States Patent
Klowan

(10) Patent No.: US 9,357,860 B1
(45) Date of Patent: Jun. 7, 2016

(54) SHOWER CADDY WITH DETACHABLE PARTS

(71) Applicant: Kenney Manufacturing Company, Warwick, RI (US)

(72) Inventor: Jeffrey Klowan, Woonsocket, RI (US)

(73) Assignee: KENNEY MANUFACTURING COMPANY, Warwick, RI (US)

( * ) Notice: Subject to any disclaimer, the term of this patent is extended or adjusted under 35 U.S.C. 154(b) by 541 days.

(21) Appl. No.: 13/667,897

(22) Filed: Nov. 2, 2012

Related U.S. Application Data

(60) Provisional application No. 61/554,868, filed on Nov. 2, 2011.

(51) Int. Cl.
*A47F 5/08* (2006.01)
*A47F 5/10* (2006.01)
*A47B 55/02* (2006.01)

(52) U.S. Cl.
CPC .. *A47F 5/10* (2013.01); *A47B 55/02* (2013.01)

(58) Field of Classification Search
CPC ..... A47B 55/02; A47K 5/04; A47K 3/281; A47K 3/001; A47F 5/10
USPC ..... 211/118
See application file for complete search history.

(56) References Cited

U.S. PATENT DOCUMENTS 846,784 A * 3/1907 Davis ..... 182/152
2,428,073 A * 9/1947 Handel ..... 211/119.004
3,391,891 A 7/1968 Garden
3,913,745 A * 10/1975 Weiss ..... 211/34
4,253,546 A * 3/1981 Uchida ..... 182/20
4,387,811 A * 6/1983 Ragir et al. ..... 211/119
4,583,646 A 4/1986 Bowman
4,846,430 A * 7/1989 Ke ..... 248/215
4,865,283 A * 9/1989 Parker ..... 248/159
5,072,958 A * 12/1991 Young ..... 280/40
5,460,279 A * 10/1995 Emery et al. ..... 211/106
5,564,720 A * 10/1996 Stringer ..... 280/30
5,588,543 A 12/1996 Finger
5,626,352 A * 5/1997 Grace ..... 280/47.29
6,082,757 A * 7/2000 Lin ..... 280/654
6,086,035 A * 7/2000 Trifilio ..... 248/305
6,464,087 B1 * 10/2002 Klein et al. ..... 211/35
D473,411 S * 4/2003 Walker ..... D6/525
6,575,315 B2 6/2003 Zidek
6,588,440 B2 * 7/2003 Varnado ..... 135/90
6,708,832 B1 * 3/2004 Hannon ..... 211/107
6,866,157 B2 * 3/2005 Shone ..... 211/90.03
7,458,475 B2 * 12/2008 Ho ..... 211/85.23
7,959,020 B2 * 6/2011 Rosen ..... 211/119.001
8,042,477 B2 * 10/2011 Lee ..... 108/147.12
2004/0188369 A1 9/2004 Yu
2006/0027516 A1 * 2/2006 Chen ..... 211/183

(Continued)

*Primary Examiner* — Korie H Chan
(74) *Attorney, Agent, or Firm* — C. Nessler

(57) ABSTRACT

A hanging shower caddy has detachable shelves which engage brackets that extend from the front of the legs of the caddy back; preferably a stringer on the shelf interacts with a tie that connects the legs, to inhibit vertical lifting of the shelf from the bracket. Alternatively, the top rear rail of a shelf engages notches at the front of the legs. A pole caddy has a removable shelf with tangs that engage holes or other features in a collar that is clamped to the pole. The legs of the back of a hanging caddy are hinged so the top of the back folds for compact shipment.

10 Claims, 5 Drawing Sheets

(56) References Cited

U.S. PATENT DOCUMENTS

2006/0032829 A1* 2/2006 Hutzler ..... 211/187
2010/0237032 A1 9/2010 Whitehall
2011/0271438 A1 11/2011 Yang
2011/0290750 A1 12/2011 Lim
2012/0091088 A1 4/2012 Didehvar
2012/0217215 A1 8/2012 Emery

* cited by examiner

SHOWER CADDY WITH DETACHABLE PARTS

This application claims benefit of provisional patent application Ser. No. 61/554,868 filed on Nov. 2, 2011.

TECHNICAL FIELD

The present invention relates to shower caddies, namely devices for holding assorted items within a domestic bathing room shower enclosure.

BACKGROUND

There is a wide variety of commercially available shower caddies, for holding things within a shower or bathtub enclosure. There are two essential types of shower caddies: hanging caddies and pole caddies.

A typical hanging shower caddy has an upper end loop which is shaped to hang from a shower nozzle which projects from the wall of a shower enclosure. One or more baskets, or shelves, are attached to legs which descend from the opposing sides of the loop, at one or more different elevations, to provide one or more horizontal surfaces upon which may be placed toiletry articles used within the shower enclosure. A typical shelf has an outer fence to retain articles. Typically the shelf depth, that is the projection of the shelf from the plane of the legs and loop, is greater than the height of the outer fence of the shelf. Some examples of hanging shower caddies are shown in U.S. Patents, as follows: Walker No. D473,411, Snell No. D479,073, Snider No. D558,657 and Snider No. D572,061.

A typical hanging shower caddy might be one foot wide and two feet or more high. Most prior art caddies have shelves which are welded to the rest of the structure and thus they cannot be readily changed with respect to choice of shelf by a user. Nor can the shelves be cleaned other than cleaning them in place or as part of the whole structure.

The predominate styles of commercial shower caddies have shapes that are ill suited for economic shipping and storage, owing to the fixed shelves and a typically long loop which enables the shelves to be at a convenient height to the user within a shower enclosure. Thus, packaging for displaying the caddy or shipping the caddy must have a commensurate size.

Some of these limitations have been addressed. For example: Flinger U.S. Pat. No. 5,588,543 shows a hanging shower caddy where the shelves have hooks which engage welded horizontal rails on a ladder-like back, so the shelves can installed at a desired elevation and can be removed when desired. Didehvar et al. Patent Publication 2012/0091088 shows a hanging shower caddy where the shelves are affixed to the back by means of plastic fittings that are slidable in what amounts to tracks formed by adjacent vertical wires. It appears the shelves can be lifted vertically from the track. Yu Patent Publication 2004/0188369 shows a hanging caddy where the shelves are foldable for shipment.

Pole caddies comprise one or more shelves which are cantilevered from a single vertical member, the pole, which typically is positioned in the corner of a bathtub enclosure. Often, the pole is spring loaded between the ceiling and a lower surface, usually the surface of a tub rim or a shower stall floor. Examples of some pole caddies can be seen in U.S. Patents as follows: Lindo No. D635,807; Hofman et al. No Des. 417, 991; and Yang et al. D569,148.

Shelves of pole caddies are most often nominally pie shape or triangle shape, and have sides which run parallel to the intersecting walls that form an inside right angle corner. Typically pole caddy shelves have a slidable collar which is set screwed to the pole at a chosen elevation, after the collar of each shelf is slipped over the end of the pole. Thus, the shelves can be removed or changed, but only by inconveniently removing the caddy from its installed location and disassembling the caddy by sliding the collar the length of the pole.

Users of shower caddies will be aware that over time they can accumulate soap scum and even mold. The typical wire basket type construction of shower caddies makes them difficult to clean because of the high surface area. It would be desirable to be able to clean shelves by power washing or washing in a dishwasher. That suggests that the shelves of pole caddies should be conveniently removable. However, the shelves of welded-wire hanging caddies cannot be disassembled. Thus, there ought to be better options for conveniently and thoroughly cleaning shelves than is enabled by the predominate styles of prior art pole caddies.

The foregoing limitations have been addressed in a way by the pole caddy described in Emery et al. Patent Publication 2012/0217215. A pole caddy having a split plastic collar (called a clip) is held in clamped position on a pole by a wire loop that is part of the rear of the shelf, thereby also supporting the shelf from the collar. The shelf can be detached, if desired, but doing that also releases the collar from its previously selected location.

Well-designed pole caddies and hanging caddies ought to provide shelves with adequate storage space and adequate vertical spacing. If the shelves or other parts of the shower caddy are detachable, the caddy should be structural stable during use. And there is always a desire to have things which are more compact and easier and less costly to store and ship.

So, there is need for an improvement in caddy construction which provides more ease of shelf removal for cleaning or replacement, and to enable more compact packaging and shipping.

SUMMARY

An object of the invention is to have a hanging shower caddy with shelves that can be readily removed for cleaning or change. A further object is to have a pole caddy with shelves that can be readily removed for cleaning. A still further object is to make a shower caddies compact for shipment.

In accord with the invention, an embodiment of hanging shower caddy has one or more shelves are supported from the legs of the back of the caddy my means of brackets that extend outwardly and upwardly from each of the legs and engage the top rear rail of the shelf. The lower portion of the back of the shelf rests against the front surface of the legs Preferably, a horizontal member at or near the bottom of the back of the shelf, called a stringer herein, is in close proximity to a horizontal tie which runs generally horizontal to connect the legs of the back. Preferably the stringer is underneath the tie. Thus, lifting or right-left tilting of a shelf is inhibited by the engagement of stringer and tie. In another embodiment, there is the same kind of engagement of stringer and tie, but the shelf is supported from the legs by either hooks that are attached to the back or by the shelf having a top rail inserted into slots in the legs. Thus, since the shelves can be removed, not only is cleaning made more convenient, but more compact shipment and packaging is enabled.

In with another aspect of the invention, a pole caddy has at least one shelf comprising two vertical wire tangs that are received in vertical hole or slots or channels of a collar that is secured to the pole at a desired location. Thus, the shelf can be lifted from the collar for cleaning or for change without moving the collar.

In further accord with the invention, a hanging caddy has a back which is foldable at hinge points at the upper ends of the lower portions of the legs which comprise the back. The upper portion of the legs and the loop at the top of the caddy folds about 180 degrees into nominal parallelism with the backside of the lower portions of the legs.

Thus, the invention enables a user may readily remove a shelf of a hanging caddy or a pole caddy for cleaning or replacement, And the invention enables compact storage and shipment of hanging caddies, by detaching baskets and or folding the back.

The foregoing and other objects, features and advantages of the present invention will become more apparent from the following description of preferred embodiments and accompanying drawings.

DESCRIPTION

This application relates to provisional patent application 61/554,833, and to design patent application 29/405,486 both filed on Nov. 2, 2011 by the present inventor. The disclosures of both applications which have ownership in common herewith are hereby incorporated by reference. The present invention is described in terms of a preferred caddy having shelves made of formed and welded wire, as are most of the caddies in the patents referred to in the Background. The invention may be alternatively made partially or wholly of plastics.

Figure 1:
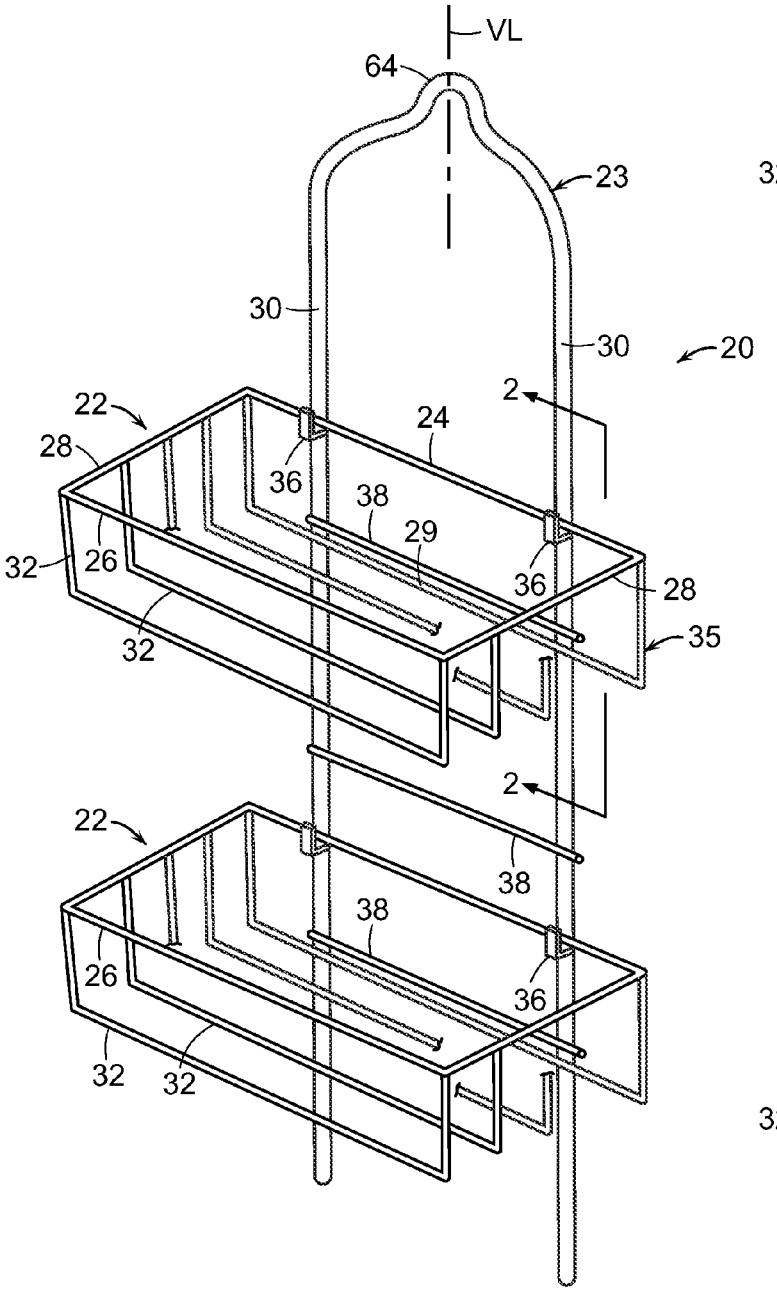
FIG. 1 is a perspective view of a portion of a hanging caddy, showing two detachable shelves supported from the back of the caddy by means of brackets.
Figure 2:
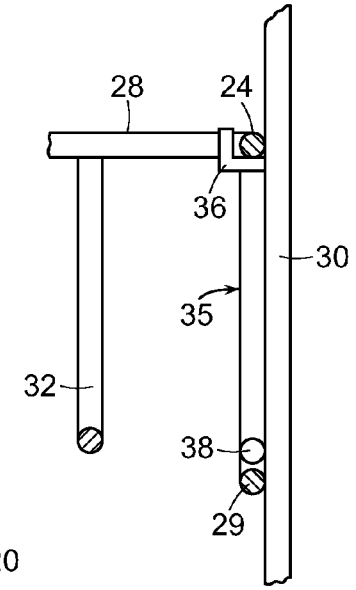
FIG. 2 is a side part-cross section view of the caddy shown in FIG. 1.

FIG. 1 and FIG. 2 are respectively a perspective view and a partial cross section side view of hanging shower caddy 20, an embodiment of the present invention. Caddy 20 has back 23 with a vertical centerline VL. The back comprises spaced apart vertical legs 30, at the top of which is loop 64 that is shaped for hanging around the pipe of a shower nozzle, not shown. The legs 30 of back 23 are connected by one or more welded horizontal members 38, called ties hereafter. Two ties 38 are shown in FIG. 1. Caddy 20 has one or more detachable shelves 22. Two shelves 22 are shown in FIG. 1; it is seen that the shelves cantilever outwardly from the fronts of the legs. Typically there are 3 or 4 shelves which may or may not be identical. See FIG. 14 for a three shelf caddy. Shelf 22 has a wire basket like shape.

Legs 30 are preferably made from solid wire rods of round cross section. The legs of this and other embodiments of shower caddy may have other cross sections, such as rectangular; optionally, they may be made of tubing. Exemplary shelves 22, like the back, are preferably made of formed and welded heavy steel wire having a surface finish or material composition which is oxidation and corrosion resistant.

Exemplary shelf 22 comprises a plurality of shallow U shape ribs 32 which run parallel to the plane of back 23, when the shelf mounted in place on the back as shown. Ribs 32 form the floor of the shelf, for supporting objects during use of the caddy. The top rear rail 24 (also called the inner rail) connects the upper ends of the rear-most rib, forming with the rib the back 35 of the shelf 22. The front rail 26 (also called the outer rail) connects the uppermost ends of the outermost rib 32 to form the front of the shelf. Opposing side rails 28 run perpendicular to the back, to connect the inner and outer rails and the upper ends of the intervening ribs 32. Shelf 22 is suspended from back 23 by hanging engagement of the rear rail 24 with two same-elevation L-shape brackets 35, one of which extends from each of the opposing side legs of 30.

FIG. 2 is a side elevation part cross-section view of the caddy of FIG. 1, and shows the bottom rear portion of the shelf, and in particular stringer 29 which is near at the bottom of the back of the shelf rests against the front surfaces of the legs due to force of gravity, as the shelf wants to pivot about the brackets 36. The term stringer refers generally to a horizontal member running at least part of the way along the length of the shelf, in one or more pieces. A stringer is part of the back 35. A stringer may be a necessary integral part of the structure of the shelf, as is stringer 29, or it may be an added member, like stringer 39 discussed below.

Preferably, as shown in FIG. 1 and FIG. 2, the elevation of stringer 29 is located adjacent to the underside of a horizontal tie 38 of the back 23 of the caddy. By "adjacent" is meant that the tie and stringer are either touching or a distance apart no more than about the diameter of the tie. Such configuration inhibits vertical movement of the rear portion of the shelf in a plane parallel to the plane of the back because stringer 29 engages tie 38. And if a shelf is overloaded with contents by the user at one side (the left or the right side in the picture of FIG. 1), there could be a tendency for the shelf to tip, i.e., to pivot in a plane parallel to plane of legs 30 about the bracket 36 which is closest to the one overloaded side. The engagement of stringer 29 with tie 38 also inhibits that kind of motion. While in the embodiments shown the stringer and ties are straight, within the scope of invention they may be other than straight. For example, the tie may be curved or undulating or otherwise irregularly shaped in the vertical or horizontal plane. Like wise, the associated top rear rail of a shelf may be curved, undulating or otherwise irregularly shaped. By rotating the outer end of the shelf upwardly, to pull the stringer away from the tie location, it can be removed from the brackets when desired.

Figure 2A:
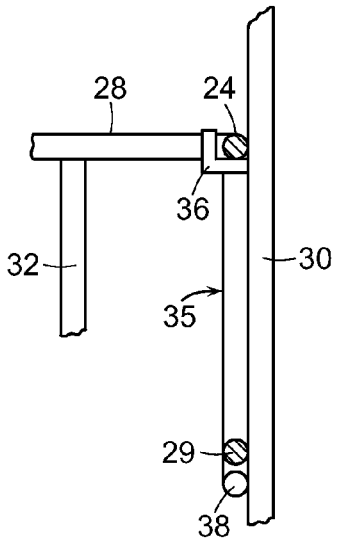
FIG. 2A is a side view like FIG. 2, showing another embodiment of caddy having some similarities with the caddy of FIG. 1.

FIG. 2A shows another embodiment in which rear stringer 29 of the shelf is vertically above the tie 38 of the back, but still in close proximity to it. Direct lifting up of the back 35 will not be inhibited, but the second tipping motion mentioned above will be.

Figure 3:
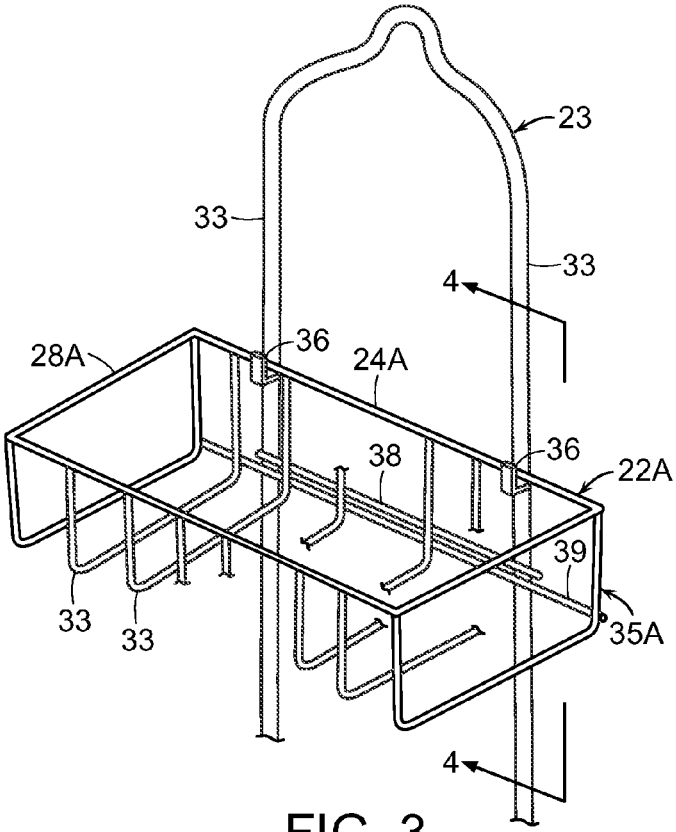
FIG. 3 is a perspective view like FIG. 1 showing a caddy having somewhat different construction of shelf.
Figure 4:
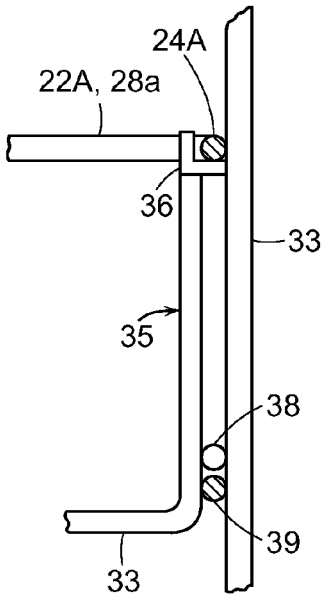
FIG. 4 is a side part-cross section view of the caddy shown in FIG. 3.

FIG. 3 is the same kind of view as FIG. 1. It shows a different configuration shelf 22A. FIG. 4 is a side view of a portion of the shelf 22A, analogous to FIG. 2. Shelf 22A has U shape ribs 33 running perpendicular to the back 35A of the shelf. The inner vertical ends of ribs 33 form part of the back 35A. A horizontal rod, stringer 39, is welded to the vertical inner ends of the ribs 33 at the back of the shelf, to provide a structure which interacts with the cross tie 38 of the back 23 of the caddy in ways described above. In this embodiment and those of other Figures, caddy elements having suffix letters which are not mentioned specifically correspond with members which have previously been described. From this embodiment, it can be appreciated that when the construction of a shelf does not provide a horizontal member suited such as a rib part which functions as a stringer 29, a stringer member like member 39 is added to the construction of the shelf in carrying out the invention. While the stringers 29, 39 are shown as continuous rods, in other embodiments of the invention, the stringer may be discontinuous. For example, in the shelf of FIG. 3, two short horizontal pieces may be provided on the shelf, one each in proximity of each of the legs of the back.

Figure 4A:
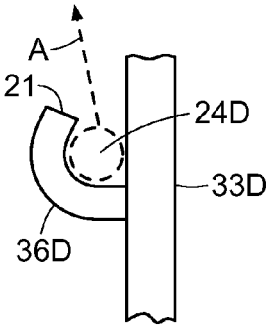
FIG. 4A shows an alternative shape bracket for receiving a caddy shelf.

FIG. 4A shows in side elevation an alternative bracket 36D. The bracket is curved outwardly and upwardly from the front of leg 33D, to engage shelf top rail 24D, shown in phantom. The spacing of the tip 21 of the bracket from the front surface of the leg is made slightly smaller than the diameter (or comparable dimension of a non-round top rail) of top rail 24D. Thus, as indicated by the arrow the rail (and thus the shelf) may be removed from engagement with the leg by moving the rail and applying sufficient force to spring the tip 21 away from the front face of the leg 33D. In the reverse motion, the rail (and thus the shelf) may be put in place and the tip of the bracket springingly moves away from the front face of the leg. This configuration inhibits inadvertent lifting and removal of a shelf from engagement with the legs. In the generality of the invention a shelf is supported by a pair of same elevation brackets, where each bracket projects outwardly from the front of a leg and has a generally horizontally extending inner portion (which may be straight or curved) and a generally vertically extending outer portion (which may be straight or curved), the outer portion terminating at a tip.

Figure 4B:
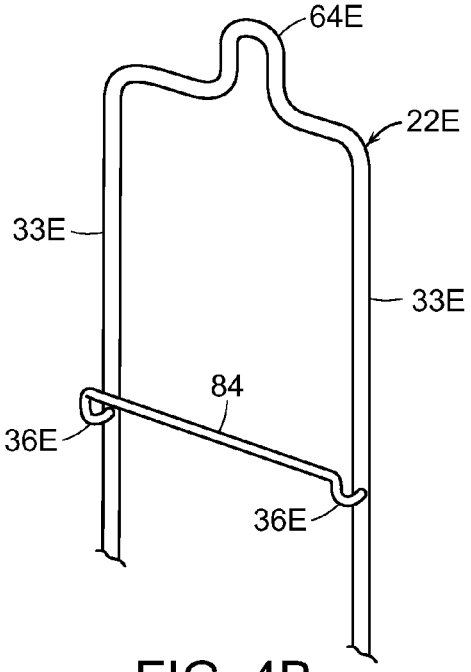
FIG. 4B shows an alternative embodiment caddy back having brackets connected by a tie.
Figure 4C:
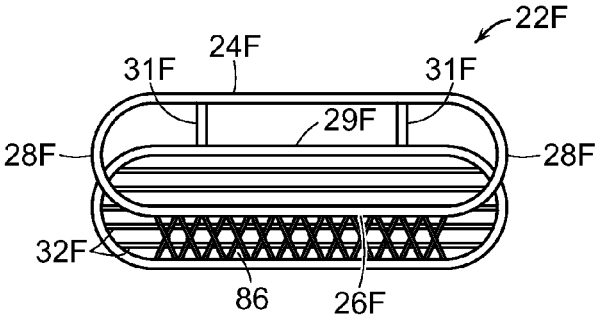
FIG. 4C shows an alternative embodiment shelf for a hanging caddy.

FIG. 4B shows back 22E, wherein the tips of the opposing side brackets 36E are connected by a bar 84, enabling elimination of a tie in vicinity of the elevation of the brackets. Back 22E may be substituted for the backs of other hanging caddy embodiments which have been described, where the back comprises brackets. FIG. 4C shows another design of shelf which may be used in the various hanging caddy invention embodiments which are described herein. Shelf 22F has oblong top and bottom rails which are connected to each other by X shape members at the front of the shelf and by spaced apart vertical struts 31F at the rear of the shelf. Ribs 32F run parallel to the back and front of the shelf, to form the bottom of the shelf. Rear top rail 24F and front top rail 26F are connected by curved side rails 28F. The members 31F, 29F and 24F form the back of the shelf.

While the invention has been described in context of two legs and associated brackets, it is within contemplation that other embodiments may have a third leg spaced between two outer legs.

Figure 5:
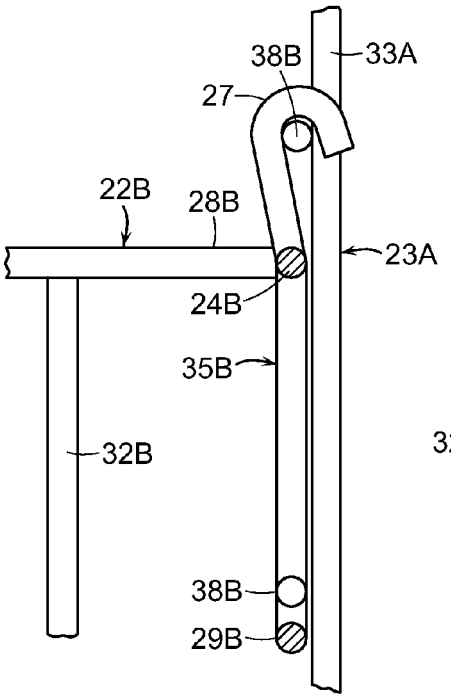
FIG. 5 is a view like that of FIG. 4, showing a portion of a caddy where the shelf has hooks, to hang from a rail of the back of the caddy.

FIG. 5 is a side view like that of FIG. 4, showing another embodiment of back 33A and shelf 22B. The back 23A is generally like back 23 of FIG. 3, but it lacks any brackets. Exemplary shelf 22B is constructed generally like the shelf of FIG. 1, but it has two or more hooks 27 which extend upwardly from the inner top rail 24B of back 35B of the shelf and engage a first cross tie 38B of the back 23A of the caddy. The stringer portion 29B of the rear most rib that forms the back 35B of the shelf is in close proximity to a second tie 35B, and interacts with it as previously described. The alternatives for constructing and placing the back stringer 29B (or a substitute stringer 39B not shown) which have been described for the embodiments above may be applied to caddies having shelves with hooks. In other embodiments of the invention, more than two hooks may be employed.

As should be appreciated from the foregoing, an artisan may employ a variety of shelf configurations in carrying out the invention, including the many configurations known in the prior art. In the generality of the invention, a hanging caddy may have a multiplicity of shelves like or equivalent to at least one detachable shelf of the kinds which have been described; and such non-detachable shelves may be combined detachable shelves in a caddy.

Figure 6:
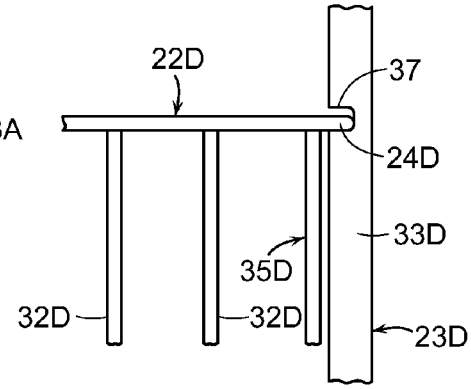
FIG. 6 is a view like that of FIG. 4, showing a portion of a caddy where the shelf engages notches in the legs of the back of the caddy.
Figure 7:
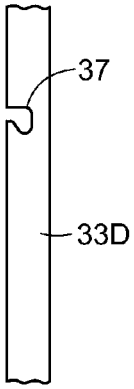
FIG. 7 is a better view of the leg of the caddy of FIG. 6.

FIG. 6 is a side view, similar to that of FIG. 5. It shows shelf 22D and associated leg 33D of caddy back 23D. Leg 33D leg is show in further detail in FIG. 7. Each leg 33D has a slot 37 within which the top rear rail 24D of shelf 22D is nested. The slot 37 has a horizontal portion which admits entry of the rail, and a vertical portion running downwardly from the horizontal portion. Downward thrust and gravity move the rail to the lower portion of the slot, whereupon it is captured within the leg by force of gravity. The lower part of the back 35D of the shelf rests against the vertical front surface of each leg 33D, to resist the rotating moment on the shelf about the point of engagement with the slot. While the capturing of the top rear rail of the shelf in the slots of the legs results in less need for a stringer 29, 39 that engages a tie of the back, that feature may be used.

Figure 8:
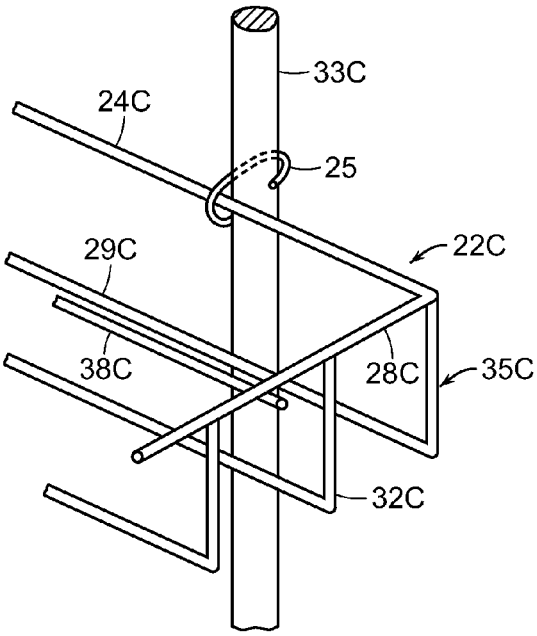
FIG. 8 is a perspective view of a portion of a hanging caddy showing how the shelf is engaged with a leg of the back by means of sling-style hanger.

FIG. 8 shows a further embodiment of the invention, namely the right side of a shelf 22C having stringer 29C which is the lower part of the rib that forms back 35C sets. Stringer 29C rests on top of tie 38C of the caddy back. Shelf upper rail 24C is held against the leg 33C by a sling or loop 25, which may be made of metal or plastic or rubber, elastic or inelastic. Preferably, the shape and angle of the sling with respect to the leg cause the sling to bind against the leg and support the shelf vertically, after a user holds the sling in its intended place while positioning the shelf at the desired elevation. The engagement of the bottom of the shelf with tie 38C further supports the shelf (i.e., the back) in the vertical direction.

Thus, it will be appreciated that in the invention a user may readily remove a shelf from the legs of a caddy back for cleaning or other purpose, or to replace it. A caddy having all detachable shelves may also be economically shipped with the shelves disassembled (and nested when the shelf shapes permit).

Figure 9:
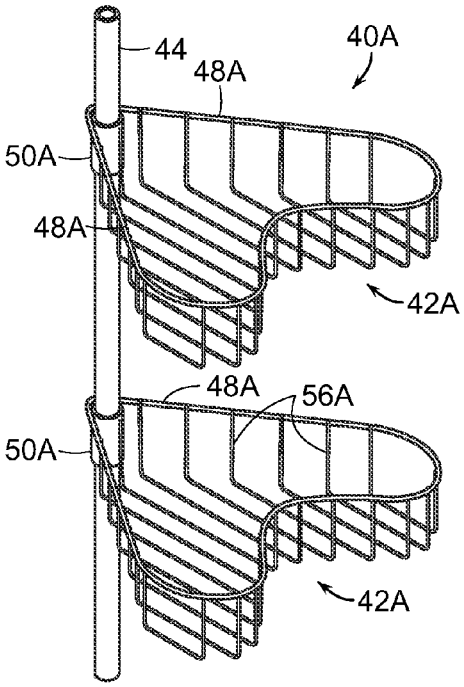
FIG. 9 PRIOR ART
FIG. 9 is a perspective view of a portion of a prior art pole caddy showing shelves which are welded to collars which are clamped to a pole.

FIG. 9-13 relate to pole caddies having detachable shelves. FIG. 9 shows a typical prior art pole caddy 40A which comprises a pole 44 to which are connected one or more shelves 42A. (Two shelves are shown.) Each shelf made of formed and welded wire and includes a top rail 48A and a multiplicity of parallel shallow U shape ribs 56A running outwardly. The top rails and the center rib are welded to collar 50A. The collar may be slid along the length of the pole and locked in position by a set screw or the like, not shown. Thus, it can be appreciated that to remove a shelf for cleaning or replacement necessitates removing the pole from its installed position and sliding the collar to the end of the pole.

Figure 10:
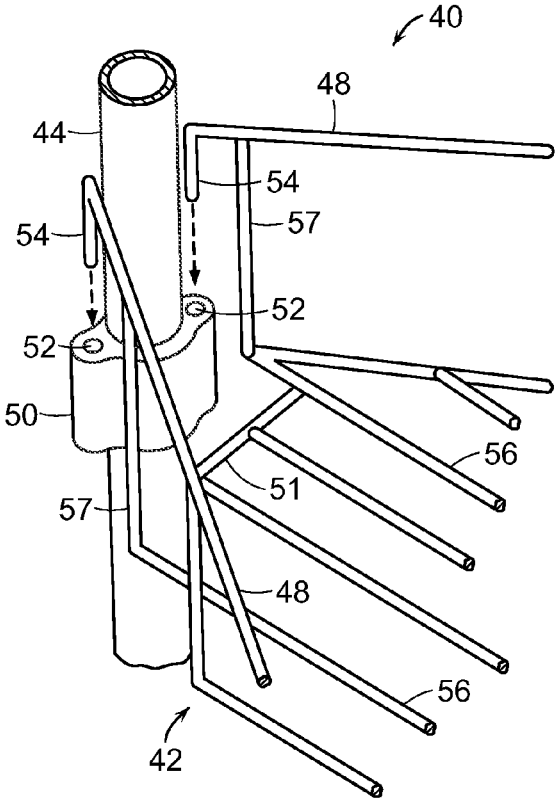
FIG. 10 is a perspective exploded view of a portion of a pole caddy having a shelf with tangs which engage openings in a collar that is clamped to a pole.
Figure 11:
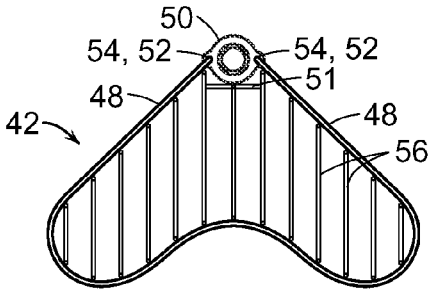
FIG. 11 is a top view of the shelf and pole of the caddy shown in FIG. 13, where the shelf is in its working position.
Figure 12:
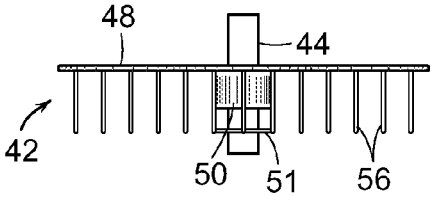
FIG. 12 is a front view of the assembly shown in FIG. 11.

A pole caddy 40 of the present invention has similar elements with corresponding numeral designations to the caddy 40A. FIG. 10 is a close up exploded view of an exemplary combination of pole 44, collar 50, and shelf 42. Collar 50 may be fastened to the pole to prevent vertical movement in fashion similar to that used with collars in the prior art; for instance, by a set screw, not shown. FIG. 11 is a top view and FIG. 12 is a front view of the FIG. 10 assembly. Although only one exemplary shelf is shown in the Figures, there typically will be a multiplicity—often three or four—shelves on a single pole. Such shelves be either identical or they may differ in size and shape. Shelf 42 is engageable and disengageable from the collar by moving it vertically relative to the collar.

Figure 12A:
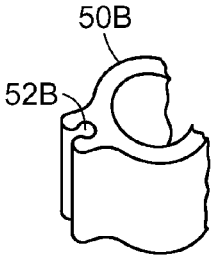
FIG. 12A shows a portion of a collar having opposing side slots for receiving tangs.

As best seen in FIG. 10, exemplary shelf 42 has spaced apart tangs 54 which slide into opposing-side vertical holes 52 of collar 50. The shelf optionally has vertical ends 57 of ribs 56 that are close to the center of the shelf may bear against the exterior or front surface of the collar, to share with the tangs the cantilever bending load of the shelf. Preferably, a part of the bottom of the shelf, such as member 51 bears against the pole, or against the collar, depending on the vertical length of the collar, for the same kind of cantilever load support, against downward bending of the shelf. See FIG. 10 and FIG. 12. Preferred collar 50 has two opposing side vertically running holes 52. In an alternative embodiment, as illustrated by the fragment of collar shown in FIG. 12A, the openings which receive the tangs may be opposing side slots 52B. When desired, set screws or other known locking means may be provided to keep the tangs from unwantedly moving upwardly. Thus, in the invention, a user may remove a shelf from the pole caddy for cleaning or other purpose by pulling it vertically from the collar which remains in place.

Figure 13:
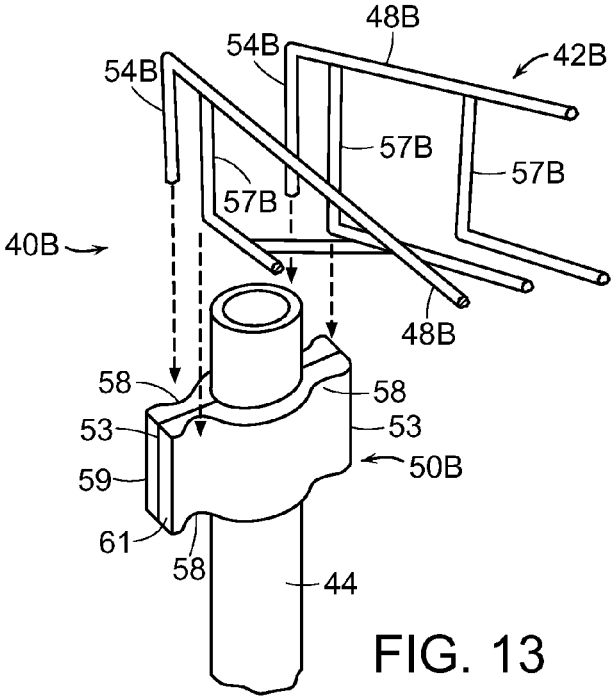
FIG. 13 is an exploded view like that of FIG. 13, showing another embodiment pole caddy comprising a split collar engaged by tangs of a shelf.

Other disengageable connections between the pole caddy shelf and a collar may be used in the invention. For example, as shown in FIG. 13, a pole caddy 40B is comprised of a combination of shelf 42B, collar 50B and pole 44. Collar 50B has opposing side wings 53. Each wing 53 has a pair of front-back vertical channels 58, each pair shaped to slidingly receive tang 54B and vertical rib end 57B. The collar may be one piece, or alternatively as illustrated in FIG. 13 collar 50B may be comprised of two halves 59, 61. Optionally, the halves may be connected by a living hinge when the collar is made of plastic.

FIG. 14-17 show an embodiment of hanging caddy 60 which has a folding back. Caddy 60 is somewhat schematically shown, particularly with respect to the details of the shelves which have welded wire construction consistent with those of the caddies described above. Caddy 60 comprises two larger shelves 62 and a smaller shelf 63, all of which are welded to the central and lower portions of legs 66. Optionally, the shelves may be mounted on the legs 66 of the back in accord with the embodiments discussed in connection with FIG. 1-8.

Figure 14:
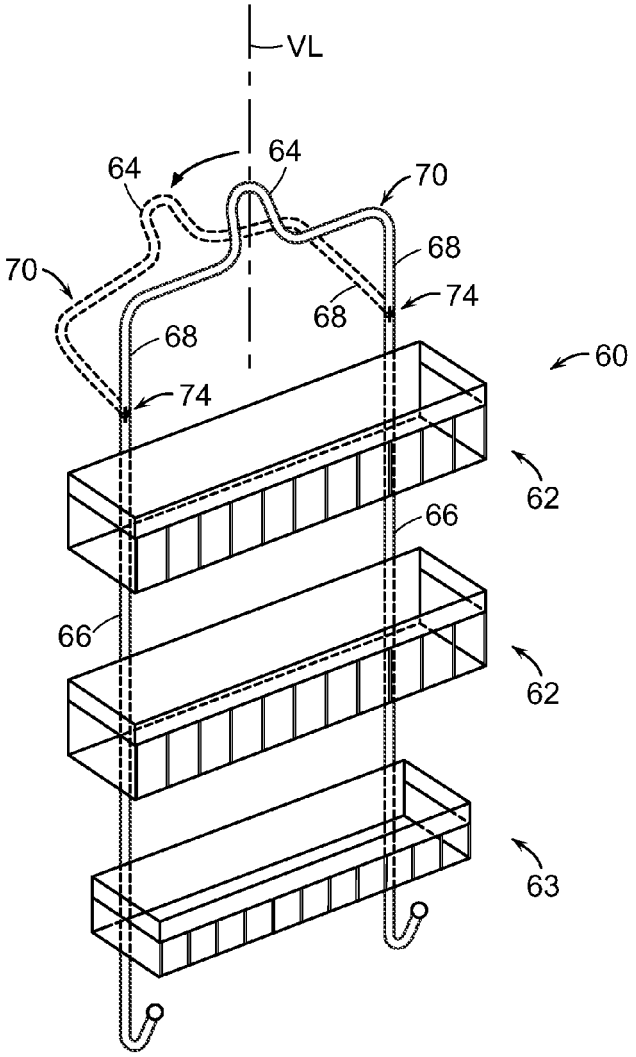
FIG. 14 is a perspective view of a hanging caddy having a folding back, showing in phantom the upper part of the back as it moves from its use position to its folded position.
Figure 15:
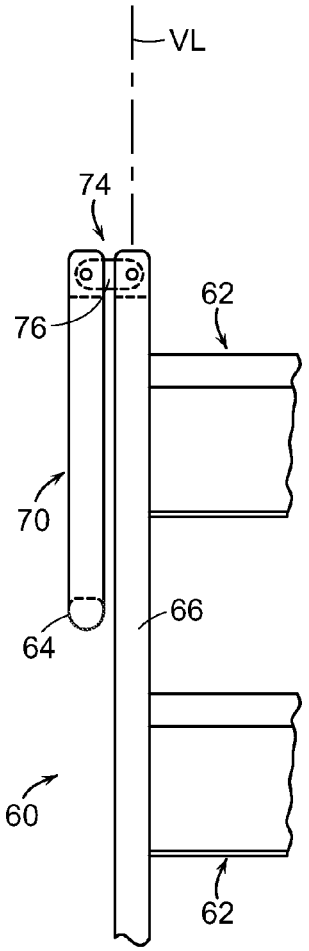
FIG. 15 is a side elevation view showing the upper part of the back of the caddy of FIG. 14 in its folded state.

In the perspective view of FIG. 14, caddy 60 is shown in its use configuration. The caddy comprises two legs which have upper and lower portions In its use configuration, the back of the caddy is essentially planar; and the plane of the back contains the vertical central axis VL of the caddy. With reference also to the partial side view caddy 60 in FIG. 15, the back of the caddy comprises a lower portion comprising the lower portions 66 of the legs and an upper foldable portion 70 which comprises the upper portions 68 of the legs, The upper and lower portions of the legs are connected to each other by hinge joint 74. The upper part 70 is comprised of upper leg portions 68 which curve inwardly to meet at loop 64. Loop 64 comprises a small nearly semi-circular portion for engaging a shower nozzle or other like projection, from which the caddy 60 is designed to hang during use. The upper part 70 of the back folds as illustrated by the phantom in FIG. 14 and the associated arrow. The side view of FIG. 15 shows the back in folded condition. Upper back part 70 has been rotated through an arc of about 180 degrees to become nominally parallel to the plane of the lower part the back, i.e., to the plane of lower leg portions 66. In its folded state, the caddy is better suited for packaging or storage.

Figure 16:
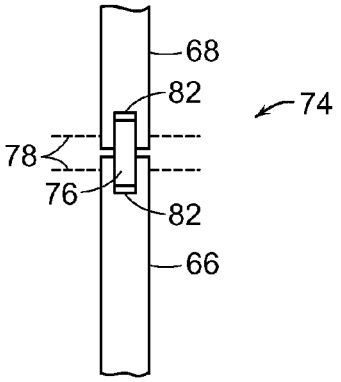
FIG. 16 is a detail view of a hinged leg assembly of the caddy of FIG. 14.

FIG. 16 is a front view showing details of an embodiment of hinge joint 74. In particular, link 76 sets within notched portions 82 of the interconnected ends of the parts 68, 66. The link 76 is pivotably fastened to leg at each of its ends by a pin, which pin presence is indicated by axes 78. The length of link 76 and having a pivot point at each end of the link enable the foldable portion 70 to move to its stowed or stored position, as shown in FIG. 15. Other embodiments of hinge joints known in the art of hinging may be employed in carrying out the invention.

Figure 17:
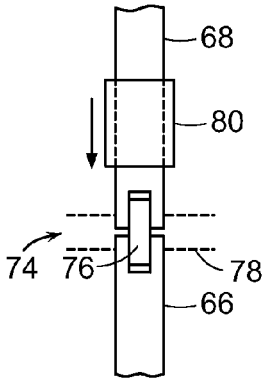
FIG. 17 is view like FIG. 16, showing an alternative embodiment hinged leg.

FIG. 17 is a view like FIG. 16, showing a variation of hinge joint. In particular, sleeve 80 is slidable along a portion of the length of leg 68, as indicated by the vertical arrow in the Figure, to a position where it surrounds the hinged joint and makes it rigid. A stop, not shown, but which will be evident to one of ordinary skill, may be used for preventing the sleeve from moving downwardly beyond the location of the hinge joint 74. Alternatively, the sleeve may be a strong elastomeric material which closely fits the back portions in vicinity of the joint. Other kinds of hinges may be used as are known in commerce, including bendable elastomeric hinges.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A hanging shower caddy comprising:

(a) a back having two spaced apart rigid vertical legs lying in a plane, the legs connected at their upper ends by a loop shaped for engaging a shower nozzle or other horizontal projection;

(b) at least one bracket projecting outwardly from the front of each leg, wherein the brackets form a same-elevation pair; each bracket comprising a generally horizontally extending inner portion attached to the leg and an outer portion extending generally vertically to a tip; and, (c) at least one shelf cantilevered outwardly from the front of each leg, the shelf having a shelf back comprising a top rear rail, the top rear rail engaged with a same-elevation pair of brackets; each shelf having a lower rear portion comprising a stringer resting against the surface of the front of each leg; wherein the at least one shelf is disengageable from said brackets for removal or replacement; wherein the back comprises at least one tie running horizontally and connecting the legs at an elevation which is lower than the elevation of said same-elevation pair of brackets; and, wherein the stringer is resting against said surface of the front of each leg at a location which is adjacent said tie.

2. The caddy of claim 1 wherein the stringer contacts the legs at a location which is below the elevation of said tie, so that vertical lifting of the rear portion of the shelf causes the stringer to press against the tie.

3. The caddy of claim 1 wherein the stringer is comprised of a multiplicity of segments.

4. The caddy of claim 1 wherein the shelf is comprised of a plurality of ribs running parallel to the plane of the shelf back, and wherein the lower most portion of the rib which is nearest rear portion of the shelf is said stringer.

5. The caddy of claim 1 wherein the distance along said inner portion which is between the tip of each bracket and the front surface of the leg on which the bracket is mounted is slightly smaller in dimension than is the top rear rail of the shelf, to thereby inhibit lifting of the top rear rail and associated rear portion of the shelf from the brackets during use of the caddy.

6. The caddy of claim 1 further comprising a horizontal bar connecting a same-elevation pair of brackets.

7. The caddy of claim 1 wherein both the inner portion and the outer portion of each at least one bracket are curved.

8. The caddy of claim 7 wherein the spacing between the tip of each bracket and the surface of the front of the leg associated with the bracket is slightly smaller than the lateral dimension of the top rear rail of the shelf, so that when the shelf top rear rail is positioned on or removed from the bracket, the bracket tip springs away slightly to increase the distance thereof from the front face of the associated leg.

9. The caddy of claim 1 wherein the legs have hinge joints at an elevation above the location of said at least one brackets, the hinge joints shaped so that the loop is foldable through an arc of about 180 degrees, from said plane of the legs to a nominally parallel plane located behind on the side of the legs which is opposite the front side of the legs from which said at least one shelf cantilevers.

10. The caddy of claim 1 further comprising at least one shelf which is permanently attached to the fronts of the legs.

* * * * *